US005393221A

United States Patent [19]

McNally

[11] Patent Number: 5,393,221

[45] Date of Patent: Feb. 28, 1995

[54] HEAT-ACTIVATED FLUE DAMPER ACTUATOR

[76] Inventor: William P. McNally, 37 Walnut St., Newport, R.I. 02840

[21] Appl. No.: 171,100

[22] Filed: Dec. 21, 1993

[51] Int. Cl.[6] ..... F23N 3/00

[52] U.S. Cl. ..... 431/20; 122/13.1; 122/17; 126/361

[58] Field of Search ..... 431/20; 126/361; 122/13.1, 16, 17, 14

[56] References Cited

U.S. PATENT DOCUMENTS 2,508,885 5/1950 Mackay ..... 431/20
4,205,293 5/1980 Melton et al. .
4,896,955 1/1990 Zider et al. .
5,067,957 11/1991 Jervis .

*Primary Examiner*—Carroll B. Dority
*Attorney, Agent, or Firm*—Fish & Richardson

[57] ABSTRACT

A heat activated flue damper actuator employing an assembly of shape memory alloy springs with linkages to a conventionally designed contemporary flue damper. The combination of the spring material, spring configuration and dimensions, linkage/fastening scheme to the flue damper shaft and placement in the water heater's heating chamber are all controlled to optimize the energy efficiency of a conventionally designed, pilot-lit or pilotless ignition, contemporary gas water heater.

19 Claims, 1 Drawing Sheet

HEAT-ACTIVATED FLUE DAMPER ACTUATOR

BACKGROUND OF THE INVENTION

The invention relates to an actuator mechanism generally useful for controlling a flue in a gas-fired water heater.

In conventional gas-fired water heaters, flue dampers are typically opened when the burner turns on and closed when the burner turns-off. Flue dampers have been controlled by weight on the damper that tends to shut the damper when there is no flow of heated exhaust, electric motors (which tend to take up to 15 seconds to close a damper), and solenoids. Ideally the damper should be rapidly closed immediately following the extinguishing of a burner flame to achieve optimal energy efficiency.

Conventional gas-fired water heaters are often positioned in remote locations with no readily available power source or in locations where it is expensive to bring electric power to the water heater, unless done so by batteries which need to be periodically replaced.

SUMMARY OF THE INVENTION

The invention features, in general, a gas-fired water heater including a water reservoir, a heating chamber, a gas-fired burner in the heating chamber, a damper mounted in an exhaust flue of the heating chamber, a heat deformable member in the heating chamber that changes shape as a function of whether the burner is fired or not fired, and a connector between the heat deformable member and the damper that tends to move the damper from one position to another as a function of shape of the deformable member.

In preferred embodiments the connector is a cable. A mechanical spring is connected to the damper to bias it. The heat deformable member is a Nitinol spring that contracts when heated beyond a certain temperature. The damper has a shaft that rotates as the damper moves between the open and closed positions, and the cable is wrapped around the shaft to cause rotation of the shaft in response to retraction of the cable.

If the heater employs a pilot light, there preferably is a second Nitonol spring in the heating chamber that changes shape as a function of whether the pilot light is lit or unlit, and a second cable that is wrapped around the shaft. The Nitonol spring cooperating with the burner is biased so as to rotate the shaft in the same direction as the mechanical spring to open the damper, and the Nitonol spring cooperating with the pilot is biased to cause rotation of the shaft in the opposite direction.

If the heater does not employ a pilot light, preferably a single Nitonol spring biases the shaft in the opposite direction from the mechanical spring, the Nitonol spring biasing the damper open and the mechanical spring biasing it closed.

Other advantages and features of the invention will be apparent from the following description of the preferred embodiment thereof and from the claims.

DESCRIPTION OF THE PREFERRED EMBODIMENT

The drawings will be described first.

Drawings

STRUCTURE, OPERATION AND MANUFACTURE

Figure 1:
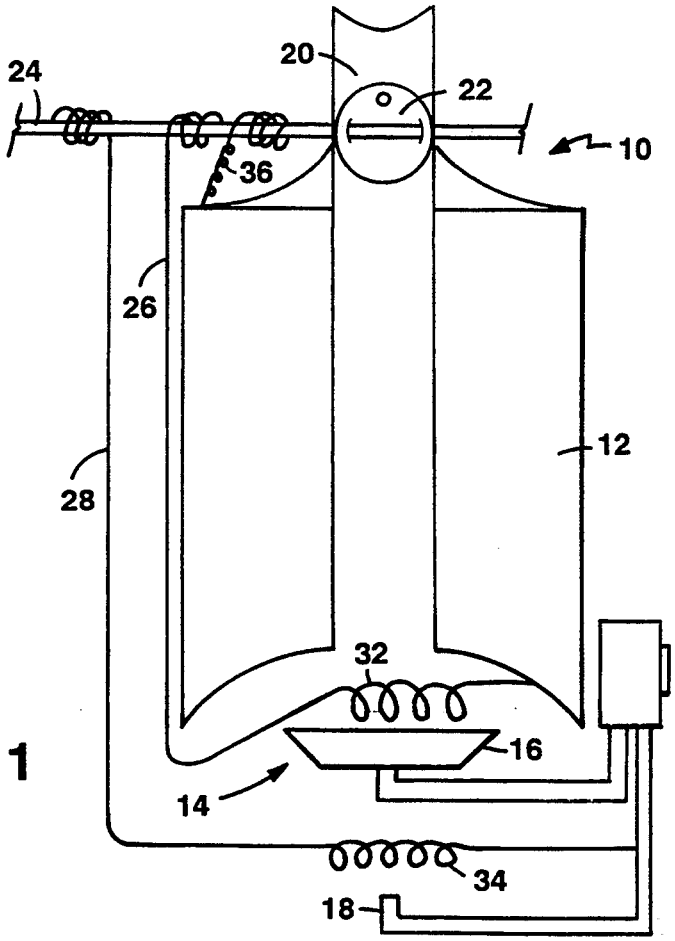
FIG. 1 is a diagram of components of a gas-fired, pilot-lit water heater with a flue actuation device according to the invention.

Referring to FIG. 1, there is shown a functional cross-section of a pilot-lit gas water heater 10 having water reservoir 12 and heating chamber 14. Gas-fired burner 16 and pilot light 18 are at the bottom of chamber 14, and exhaust flue 20 is at the top. Damper 22 is mounted in flue 20 for rotation about its shaft 24 between open and closed positions. Cables 26 and 28 are wrapped around shaft 24 and are respectively connected to heat deformable spring 32 and heat deformable spring 34. Springs 32 and 34 are made of a nickel titanium alloy commonly referred to as Nitinol and available from Shape Memory Applications, Inc., Sunnyvale, Calif. Mechanical spring 36 is directly connected to shaft 24.

Spring 32 is mounted in the heating chamber over burner 16 so that it contracts or extends as a function of whether burner 16 is fired or not; it is wrapped around shaft 18 in the direction of opening damper 22. Spring 34 is mounted in the heating chamber over pilot light 18 so that it contracts or extends as a function of whether pilot light 18 is lit or unlit; it is wrapped around shaft 24 in the direction of closing damper 22. Springs 32, 34 are each firmly anchored to the structure of water heater 10 at one end and connected to respective cables 26, 28 at the other. The springs and attached cables should be maintained taut with no significant play or slack; preferably lubricated, coaxial sheathed cables are used for this purpose.

Mechanical spring 36 is located outside of the heating chamber and also has tight connection points and linkage and is firmly attached to shaft 24 of flue damper 22 after making at least one full turn in the direction indicated. This places a torque on shaft 24 tending to open damper 22.

In operation, when burner 16 is on and pilot light 18 is lit, springs 32 and 34 are heated above the shape recovery point (crystal structure transformation), contract, and have increased spring force. Attached cables 26, 28 have increased tension, and the combined torques of spring 36 and spring 32 overpower the torque of spring 34 and cause rotation of shaft 24 to the damper open position.

When burner 16 goes off while pilot light 18 is still on, spring 32 relaxes, and reduced tension in cable 26 allows spring 34 to overpower springs 32 and 36, quickly closing damper 22 and conserving energy. The damper is closed in approximately one second, thereby realizing virtually all of the efficiency gain available by closing damper 22.

When pilot light 18 is unlit, and burner 16 is off, spring 34 relaxes. The lower torque caused by the reduced tension in cable 28 in combination with the torque caused by spring 32 and spring 36 overpower spring 34. This causes damper 22 to open to vent gas from unlit pilot light 18.

Flue damper 22 thus is actuated utilizing the thermal (phase change) memory characteristics of the Nitinol springs. The invention taps a minute amount of energy from the gas flame to actuate the flue damper. The invention avoids unnecessary loss of energy from the system when there is no further need to exhaust the heating chamber, significantly enhancing the energy efficiency of the gas water heater.

This invention provides an actuator which is reliable, quiet, inexpensive, fast-acting, automatic and meets the safety standards required by the American Gas Association. In addition, the actuator mechanism is easy to install and requires very little space.

In the event of failure of the damper to open promptly following the ignition of the heater flame (due to a stuck damper mechanism, broken or damaged components, etc.) the gas supply is shut off by a separate mechanism.

The Nitinol springs can have any of a number of possible combinations of wire diameter, spring configuration (diameter and number of coils) and heat treatment. They must be positioned in heating chamber 14 so that the appropriate flame brings each spring into the temperature range required for actuation but does not overheat the springs to the point where either spring's shape recovery properties may be lost. The two Nitinol springs of the preferred embodiment of the invention are identical to each other in the interests of low cost and are small in wire diameter for quick response. The number of coils and coil diameter are sized for an adequate strength of recovery and stroke length, respectively. The alloy composition and its heat treatment set the temperature of the spring's actuation—a relatively low temperature results in quick damper opening whereas a relatively high temperature results in quick damper closing.

The springs are fabricated from 0.03" diameter wire and have approximately 13 (close-wound) coils with an outside diameter of 0.22". This spring has a free length of 0.40", a high temperature installed length (above actuation temperature) of 0.79", a low temperature length of 1.29" and an alloy composition/heat treatment such that its actuation temperature is approximately 60 degrees C.

To calculate other technically equivalent combinations of these parameters, a spring pulling force and stroke distance must be estimated (from the damper shaft diameter, estimated losses in cables 26–28, and the resistance of the damper to rotation). From these values the formulas and procedures outlined below can be followed:

$$\text{wire diameter } d = \sqrt{\frac{8Wpc}{\pi T_c}}$$

where $$W = \text{Wahl correction factor} = \frac{4c-1}{4c-4} + \frac{0.615}{c}$$

$$c = \frac{\text{average spring diameter}}{\text{wire diameter}} = 6 \text{ to } 10 \text{ for most shape memory applications}$$

$p$ = estimated spring pulling force required in lb.
$T_c$ = maximum shear stress (a low value such as 20 ksi is required for a good fatigue life)
spring outside diameter $D = cd + d$ $$\text{Number of spring coils } n = \frac{ds}{.0083\pi D^2}$$

-continued where $$S = \text{required stroke distance} = .25\pi \times \text{shaft diameter} + \text{estimated linkage cable losses}$$

High temperature length $L_h = L_f + \delta_h$
where
$L_f$ = free length (exclusive of end hooks) = $nd$ $$\delta_h = \text{high temperature deflection} = \frac{P}{K_h}$$

$$K_h = \text{high temperature spring rate} = \frac{G_h d^4}{8\, n\, D^3}$$

$$G_h = \text{high temperature (100° C.) shear modulus} = 3 \times 10^6 \text{ psi}$$

Low temperature length $L_1 = L_h + s$

The preferred embodiment and alternate configuration designs calculated as per the above assume a flue damper shaft diameter of 0.12" and a pretensioning of (about) 1 lb. in each spring. As the flue damper is restricted to rotation within a 90 degree arc between an open and closed position, the responsiveness (distance through which it must contract when heated) is ¼ of this diameter's circumference. In addition, each spring's tension must be such throughout its movement range that the resultant torque of the three springs overcomes any friction in the flue damper shaft bearings and losses in the linkage cable to yield the correct damper movement. Hence, variations in these variables (shaft diameter, linkage cable losses and pretension) will need to be considered.

It should be noted that a spring force and/or a stroke distance somewhat higher than that required to rotate the damper is not only technically acceptable but desirable. It allows for minor changes in the damper's rotational resistance and/or friction or slack losses in the cable linkage. Technical acceptability is determined by the configuration's ability to effect the correct damper movement.

Figure 2:
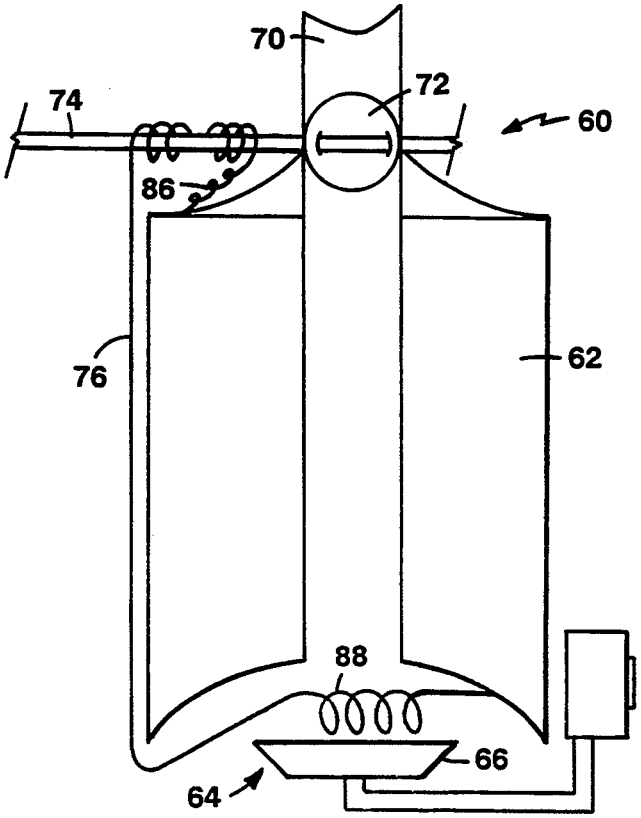
FIG. 2 is a diagram of components of a gas-fired, pilotless water heater with a flue actuation device according to the invention.

Referring to FIG. 2, there is shown a functional cross-section of a pilotless gas-fired water heater 60 having a water reservoir 62 and heating chamber 64. Gas-fired burner 66 is located in chamber 64, and exhaust flue 70 is at the top. Damper 72 is mounted in flue 70 for rotation about its shaft 74 between open and closed positions. Cable 76 is wrapped around shaft 74 and is connected to heat deformable spring 82. Spring 82 is made of Nitinol. Mechanical spring 86, which is fabricated from stainless steel, is wrapped around shaft 74 and is directly connected to the water heater housing.

Spring 82 is mounted in heating chamber 64 in close proximity to burner 66 so that it contracts or extends as a function of whether burner 66 is fired or not; it is wrapped around shaft 74 in the direction indicated so that spring 82 places a torque on shaft 74 in the direction of opening damper 72. Spring 82 is firmly anchored to the structure of water heater 60 at one end and connected to cable 76 at the other. The spring and attached cable should be maintained taut with no significant play or slack; preferably lubricated, coaxial sheathed cables are used for this purpose.

Mechanical spring 86 is located outside of heating chamber 64. Spring 86 also has tight connection points and linkage and is firmly attached to shaft 74 of flue damper 72 after making at least one full turn in the direction indicated. This places a torque on shaft 74 tending to close damper 72.

In operation when burner 66 is on, spring 82 is heated above the shape recovery point (crystal structure transformation), contracts, and has increased spring force. Attached cable 76 has increased tension which overpowers spring 86 and causes rotation of shaft 74 to the damper open position.

When burner 66 goes off, spring 82 relaxes, and reduced tension in cable 76 allows spring 86 to overpower spring 82, quickly closing damper 72 and conserving energy. The damper is closed in approximately one second, thereby realizing virtually all of the efficiency gain available by closing damper 72.

In the event of failure of either the flame to ignite or the damper to open promptly following the ignition of the flame (due to a stuck damper mechanism, broken or damaged component, etc.) the gas supply is shut off by a separate mechanism.

The Nitinol spring can have any of a number of possible combinations of wire diameter, spring configuration (diameter and number of coils) and wire alloy composition. It must be positioned in heating chamber 64 such that the flame brings it into the temperature range required for actuation but does not overheat the spring to the point where its shape recovery properties may be lost. A small wire diameter yields the desired quick response, and the number of coils and coil diameter are sized for an adequate strength of recovery and stroke length, respectively. The Nitinol spring of the preferred embodiment of the invention is fabricated from 0.035" diameter wire and has approximately 12 (close wound) coils with an outside diameter of 0.25". This spring has a free length of 0.42", a high temperature installed length (above actuation temperature) of 0.83", a low temperature installed length of 1.33", and alloy composition/heat treatment such that its actuation temperature is approximately 60° C.

To calculate other technically acceptable combinations of these parameters, a spring pulling force and stroke distance must be estimated (from the damper shaft diameter, estimated losses in cable 76, and the resistance of the damper to rotation). From these values, the formulas and procedure already described for the FIG. 1 embodiment can be followed.

Having described a preferred embodiment of the invention, it will now be apparent to one of skill in the art, that other embodiments incorporating its concept may be used. It is felt, therefore, that this invention should not be limited to the disclosed embodiment, but rather should be limited only by the spirit and scope of the appended claims.

What is claimed is:

1. A gas-fired water heater comprising a water reservoir, structure defining a heating chamber in heat communication with said water reservoir and an exhaust flue for exhausting heated gases from said chamber, a gas-fired burner in said heating chamber, a damper mounted in said exhaust flue for movement between open and closed positions, a first heat deformable member in said heating chamber that changes shape as a function of whether said burner is fired or not fired, and a first connector between said first heat deformable member and said damper that tends to move said damper from one position to another as a function of shape of said deformable member.

2. The heater of claim 1 wherein said connector is a cable.

3. The heater of claim 1 further comprising a mechanical spring that is connected to said damper to bias it in the same direction as the direction in which said damper is moved by said first heat deformable member when said burner goes from being not fired to being fired.

4. The heater of claim 3 wherein said first heat deformable member is a spring that biases said damper in the same direction that it is moved by said first heat deformable member when said burner goes from being not fired to being fired and that contracts when heated.

5. The heater of claim 3 wherein said damper has a shaft that rotates as said damper moves between said open and closed positions, and said first connector is a first cable that is wrapped around said shaft to cause rotation of said shaft in response to retraction of said first cable.

6. The heater of claim 5 wherein said mechanical spring is connected to tend to bias said shaft in the same direction of rotation as the direction caused by retraction of said first cable.

7. The heater of claim 1 further comprising a pilot light in said heating chamber in position to light said burner, a second heat deformable member in said heating chamber that changes shape as a function of whether said pilot light is lit or unlit, and a second connector between said second heat deformable member and said damper that tends to move said damper from one position to another as a function of shape of said deformable member.

8. The heater of claim 7 wherein said second heat deformable member is connected by said second connector so that, when said pilot light goes from being lit to being unlit, said damper is biased in the opposite direction from the direction in which said damper is biased by said first heat deformable member when said torch goes from being fired to being not fired.

9. The heater of claim 8 wherein said first and second heat deformable members are springs that contract when heated above their phase change temperatures.

10. The heater of claim 9 further comprising a mechanical spring that is connected to said damper to bias it in the opposite direction from the direction in which said damper is biased by said first heat deformable member when said burner goes from being fired to being not fired.

11. The heater of claim 7 wherein said damper has a shaft that rotates as said damper moves between said open and closed positions, said first connector is a first cable that is wrapped around said shaft to cause rotation of said shaft in response to retraction of said first cable, and said second connector is a second cable that is wrapped around said shaft to cause rotation of said shaft in the opposite direction in response to retraction of said second cable.

12. The heater of claim 11 wherein said first and second heat deformable members are springs that contract when heated above their phase change temperatures.

13. The heater of claim 12 further comprising a mechanical spring that is connected to said damper to bias it in the same direction as the direction in which said damper is biased by said first heat deformable member when said burner goes from being fired to being not fired.

14. The heater of claim 1 wherein said heat deformable member is a NiTi spring.

15. The heater of claim 12 wherein said heat deformable members are NiTi springs each having a wire diameter of about 0.03", a coil outside diameter of about 0.22", a number of coils about 13, and a heat treatment such that its crystal structure transformation (Martenite to Austenite) occurs below 60 degrees C.

16. The heater of claim 1 further comprising a mechanical spring that is connected to said damper to bias it in the opposite direction from the direction in which said damper is moved by said first heat deformable member when said burner goes from being not fired to being fired.

17. The heater of claim 16 wherein said heat deformable member is a spring that biases said damper in the same direction that it is moved by said first heat deformable member when said burner goes from being not fired to being fired and that contracts when heated.

18. The heater of claim 17 wherein said damper has a shaft that rotates as said damper moves between said open and closed positions, and said first connector is a first cable that is wrapped around said shaft to cause rotation of said shaft in response to retraction of said first cable.

19. The heater of claim 18 wherein said mechanical spring is connected to tend to bias said shaft in the opposite direction of rotation from the direction caused by retraction of said first cable.

* * * * *